US006814656B2

(12) United States Patent
Rodriguez

(10) Patent No.: US 6,814,656 B2
(45) Date of Patent: Nov. 9, 2004

(54) SURFACE TREATMENT DISKS FOR ROTARY TOOLS

(76) Inventor: Luis J. Rodriguez, 60 Fourth St., South Orange, NJ (US) 07079

( * ) Notice: Subject to any disclaimer, the term of this patent is extended or adjusted under 35 U.S.C. 154(b) by 248 days.

(21) Appl. No.: 09/812,664

(22) Filed: Mar. 20, 2001

(65) Prior Publication Data

US 2002/0137432 A1 Sep. 26, 2002

(51) Int. Cl.[7] ..... B24B 1/00
(52) U.S. Cl. ..... 451/359; 451/353; 451/528
(58) Field of Search ..... 481/357, 359, 481/353, 548, 550; 451/539, 526, 528–538

(56) References Cited

U.S. PATENT DOCUMENTS 1,779,682 A * 10/1930 Stratford
2,281,722 A * 5/1942 Smith
5,439,330 A * 8/1995 Bayer et al. ..... 451/57
5,564,969 A * 10/1996 Tsang ..... 451/358
5,725,423 A * 3/1998 Barry et al. ..... 451/359
5,842,250 A * 12/1998 Zhadanov ..... 451/359
6,179,696 B1 * 1/2001 Duffy ..... 451/357
6,244,943 B1 * 6/2001 Bohler et al. ..... 451/294
6,261,164 B1 * 7/2001 Rivard et al. ..... 451/359

OTHER PUBLICATIONS

Tool and Manufacturing Engineers Handbook–vol. 1. Society of Manufacturing Engineers. 1983. p. 11–57.*

* cited by examiner

*Primary Examiner*—Eileen P. Morgan

(57) ABSTRACT

A conical disk having an obtuse angle that is attached to a rotary tool, like a power drill for example, as an accessory for the treatment and finishing, of surfaces, like sanding, for example. By virtue of its shape, the disk enables an even treatment of surfaces with a minimal effort, with uniform wear of the materials in friction, while preventing undesirable vibrations and forced operation that provoke continuous disengagement from the rotary tool. Other than its different shape, the disk (24) is similar to conventional disks, comprising basically two elements: A surface treating side (26) and attachment means (32).

20 Claims, 6 Drawing Sheets

SURFACE TREATMENT DISKS FOR ROTARY TOOLS

CROSS-REFERENCE TO RELATED APPLICATIONS

Not applicable.

BACKGROUND

1. Field of the Invention

This invention relates to surface treatment disks, especially to such surface treatment disks which are attachable to rotary tools.

BACKGROUND

2. Description of Prior Art

Different types of surface treatment disks are available in the market; including abrasive disks, buffing disks, polishing disks, etc. that are attachable to a rotary tool, such as a drill, a saw, a buffing machine, etc., and these machines may be portable or stationary. (Note: The terms "treatment", "treating", "finishing" and their variations, or equivalents are alternatively used in this application, and indicate the action of a disk applied to a surface.)

In general, the purpose of these disks is to aid in the treatment of surfaces that do not have any high or low relieves or any other intricate shapes. In other words, the surfaces or portions of surfaces to be treated are either flat or if they are not flat, they have a continuous and even shape.

These prior art disks, and the system to treat surfaces therewith were first introduced into the marketplace by the industry in an attempt to maximize the utility and as a result, the demand for power drills, since they would obviate the need to purchase a dedicated sanding machine, which would represent substantial savings to the consumer.

A notable variation of this system consists of a rubber padded disk in conjunction with circular sandpaper adhered or otherwise fastened to said rubber padded disk.

This prior art system fails to provide an adequate alternative to dedicated sanding machines. The reason is precisely that the principles of dedicated sanding machines have been extrapolated to drills and other rotary machines, and thus they have a flat shape. And there is where the problem resides.

Dedicated sanding machines can function with this type of flat disks because their movement is either of an orbital nature or of an oscillatory nature.

When using a dedicated sanding machine, the force is uniformly distributed throughout the surface of the disk and then applied to the surfaces being treated, and the disk may be in a controlled motion when flatly in contact with the surface being treated.

But that is not at all the case with rotary tools, where the movement is of a rotary-centrifugal nature.

When the prior art disks are attached to rotary tools, the results are very far from satisfactory. The method is not practical or functional, as it is demonstrated by the following specific problems:

1) The centrifugal force directs all the action to the periphery of the disk. This constitutes a critical flaw of the system, since the periphery is only a nominal area, while the entire surface area of the disk is virtually inert. Hence, these other problems are derived from this critical defect:

2) If the rotary disk is applied flatly parallel to the surface being treated, a tendency to inertia occurs. (See FIGS. 1 and 3.) A "brake" effect is produced and any abrasive or polishing or otherwise finishing effect is voided.

3) If the rotary disk is applied in an angle to the surface, all the finishing effect will be applied by the periphery of the disk, treating a minimal area, as indicated before. (See FIGS. 2 and 3.) But this is further aggravated by the concentrated strong effect, particularly if the disk has abrasive properties, that will have a carving effect on the surfaces being treated, which is additionally very difficult to control.

4) Due to the high resistance offered by the surface being treated to the disk, a vibration is provoked. This vibration causes the disk to detach from the rotary tool very frequently.

5) Likewise, when using sand paper attached to a padded disk, this vibration causes the sand paper to be constantly detached. This has an even more damaging effect if the sand paper is adhered to the padded disk. After two or three detachments and re-attachments, the fastening strength of the adhesive is substantially reduced. This is further aggravated by all the dust that contaminates the adhesive coating of the sand paper, rendering it useless, As a result of the preceding, other significant problems are generated:

6) Excessive fatigue and low productivity are imposed on the operator.

7) Surfaces are unevenly treated.

8) Uneven wear of finishing disks and accessory materials occurs.

9) High risk of slipping of the rotary tool, due to the uneven contact of the surfaces, which entails a risk of harm to operator, his/her clothes, and/or surrounding objects.

The preceding problems relate to the use of the disks when flatly applied to the surface being treated, or when applied in an angle. But there is another scenario. Probably the most common scenario, with some of the preceding disadvantages, plus some others, as follows:

10) In an effort to equilibrate the two extreme modes of operation mentioned before (a. Applying the disk flatly against the surface being treated, and b. Applying the disk in an angle to the surface being treated,) the operator may instinctively force the disk into a more natural shape for the task, if the disk offers some flexibility. While the effort is substantial (most probably operator will use both hands) the flexibility is minimal. (See FIG. 4.) Thus, what is achieved is an increased fatigue to operator in exchange for an insignificant improvement in performance, plus a highly enhanced risk of disengagement of the disk from the rotary tool, and/or sand paper or any other surface treatment accessory from the disk. This effort to force the disk into a more co-operative shape, may cause the fracture of the disk, as it commonly happens with wire disks for abrasive purposes, as described by FIGS. 5, 6 and 7.

OBJECTS AND ADVANTAGES

Accordingly, several objects and advantages of my invention are:

1. Permits an easier treatment of surfaces, and consequently reduces fatigue.
2. Permits a faster treatment of surfaces, and consequently increases productivity.

3. Permits more control of the treatment of surfaces.
4. As a result of #3., permits a uniform and even treatment of surfaces for a better quality job.
5. Prevents the uneven wear of the finishing materials.
6. Prevents the rupture of abrasive metallic disks, that occurs in the concentric surrounding area where connected to the tool.
7. Prevents the slipping of the disks due to an uneven contact with surfaces being treated.
8. As a result of #7., prevents any accident against operator of rotary tool, operators clothes and/or any surrounding objects.
9. Minimizes incidence of disengagement from the tool, which requires a constant re-attachment of the disk to the machine or tool as vibration is reduced or eliminated.
10. When using sand paper disks, permits a stronger adhesion, as vibration is reduced or eliminated, preventing the need to constantly re-attach the sand paper disks
11. As a result of #10., extends durability of paper disks, as repeated attachments wear their adhesive strength.
12. The good bonding quality of the paper disks and the usefulness of the disks is also extended as contamination of the adhesive substance that occurs when the disks are detached and exposed to the dust is prevented.
13. Manufacturing of the disk appears highly compatible with the established systems. Implementation should be facilitated by this.
14. As a result of #13., costs to produce should be very similar. Price to consumer could be very similar, while there is a significantly higher value.
15. As this system actually uses and exploits the centrifugal force to treat surfaces, disks could be of a larger diameter for a yet better performance.

Further objects and advantages of my invention will become apparent from a consideration of the drawings and ensuing description.

SUMMARY

In accordance with the present invention an improved surface treatment disk for rotary tools comprises a conical shape, said conical shape having an obtuse angle.

DRAWINGS

Brief Description

DRAWINGS

Reference Numerals

20 disk of the prior art.

22 surface being treated or to be treated.

24 disk of the present invention.

26 side of disk having treating properties.

28 base disk with no surface treating properties.

30 removable layer attachable to base disk 28 having surface treating properties.

32 means to attach disk to rotary tool.

DRAWINGS

Prior Art

Since an analysis of the prior art disks lead to the conception of the present invention, FIGS. 1–7 inclusive show the different problems of this prior art and the root of its problems.

Figure 1:
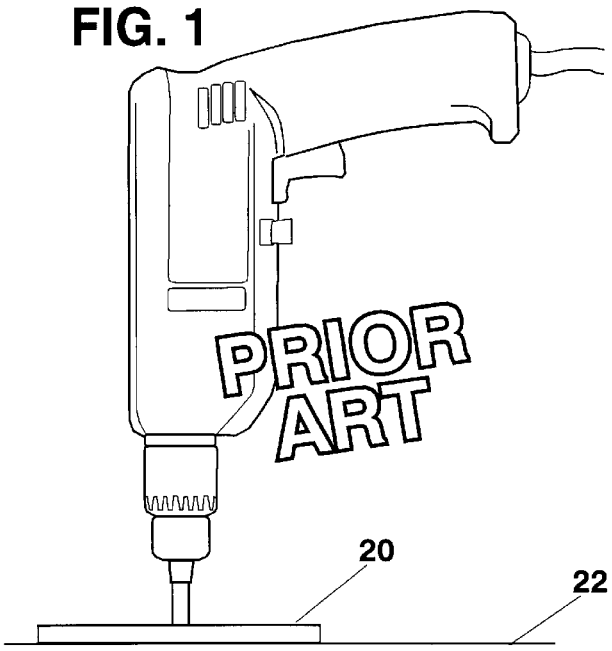
FIG. 1 is a side view of a drill as an example of a rotary tool, having a prior art finishing disk, flatly applied to a surface.

FIG. 1 shows a side view of a rotary tool (drill in this case) having a prior art finishing disk 20 applied flatly parallel to a surface 22. The treating action of the disk is insignificant, as the friction against the surface creates a "braking" effect, due to the centrifugal force generated by the rotary tool, as opposed to the orbital or oscillatory motion of dedicated sanding machines that can function properly when flatly applied against the surface being treated.

Additionally, the rotary tool is very difficult to control when used in this fashion. Slipping of the tool is very likely to occur, which may cause harm to the operator, the operator's clothes and/or surrounding objects.

The efforts to control the tool and the unavoidable slipping cause a vibration that provokes the recurrent disengagement of the disk and/or the sanding disks or other finishing accessories.

Figure 2:
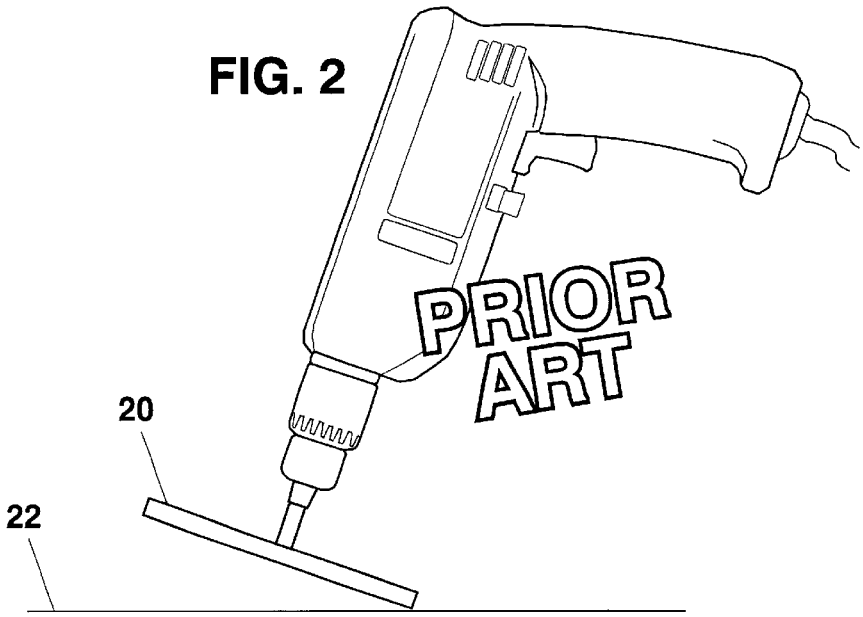
FIG. 2 is a side view of a drill as an example of a rotary tool, having a prior art finishing disk, diagonally applied to a surface.

FIG. 2 shows a side view of a rotary tool (drill in this case) having a prior art finishing disk 20 applied in an angle to a surface 22. The treating action of the disk is of questionable quality. The disk and the system it embodies; specially if the function performed is of an eroding nature; may actually have counterproductive effects.

Since all the force is directed to the periphery of the disk, and only the periphery of the disk is in contact with the surface, there is actually a minimal area being treated, and the magnitude of this treatment is excessive; to the point that it actually has a carving effect. Additionally, control of the tool is very difficult, as slipping is very likely to occur, with the inherent risks against operator, operators clothes and/or surrounding objects.

The difficulty to control the rotary tool, and the likely to occur slipping produce vibrations that eventually cause the constant detachment of the disk and any other accessories like sandpaper fastened thereto.

Figure 3:
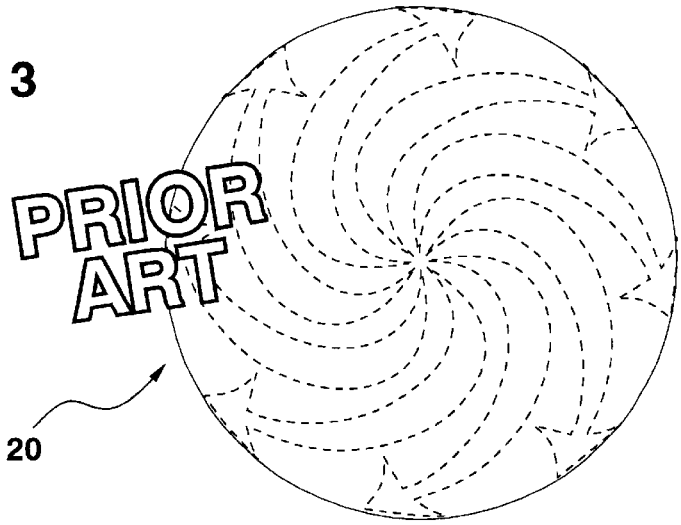
FIG. 3 is a plan frontal view of a prior art finishing disk, showing the direction of the centrifugal force.

FIG. 3 shows a plan frontal view of a disk 20 of the prior art, where dotted arrows indicate the direction of the centrifugal force, pointing to the periphery of the disk.

Figure 4:
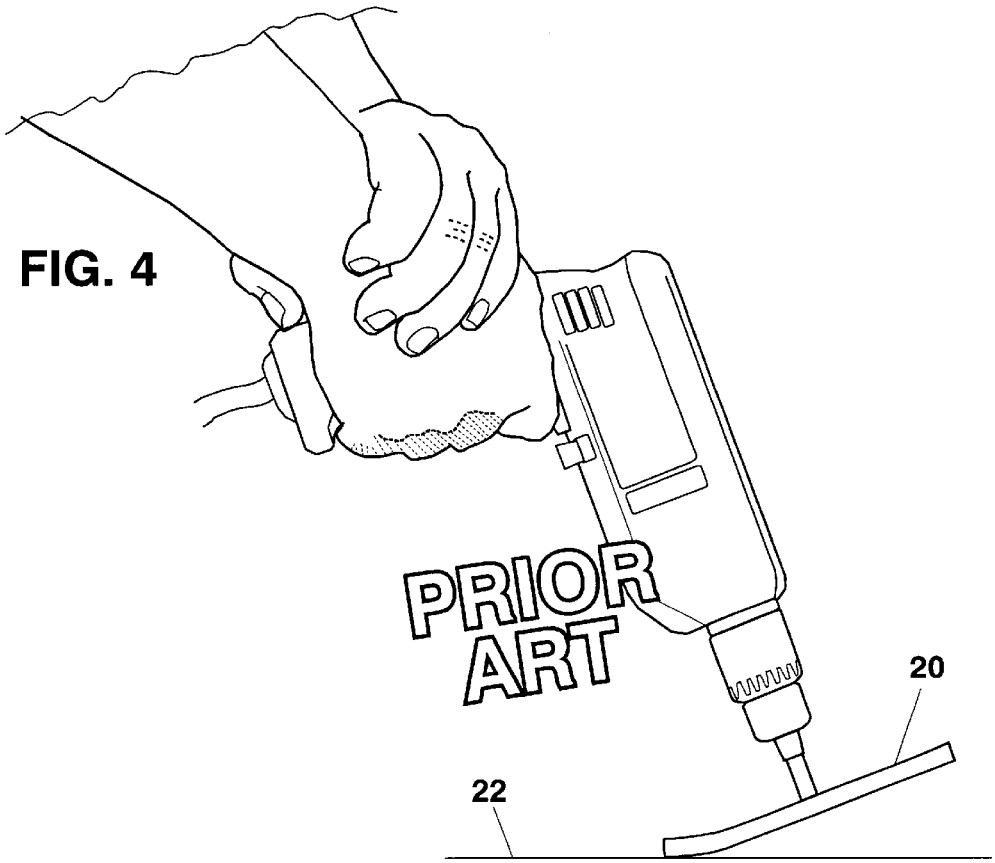
FIG. 4 is a side view of a drill as an example of a rotary tool having a prior art finishing disk, and both hands of operator applying pressure of rotary tool against surface.

FIG. 4 shows a side view of a rotary tool with a disk 20 of the prior art, being applied against surface 22, with both hands of operator, to increase the force of operation, in an effort to overcome the problems explained with FIGS. 1 and 2.

Since this force results excessive and unnatural, new problems are created in the process, while some of the problems illustrated with FIGS. 1 and 2 still persist.

a) An excessive wear and tear is imposed to the materials used. Materials may actually collapse and brake. Wire disks used for abrasive purposes will eventually brake, as later illustrated by FIGS. 5, 6 and 7.

b) An uneven treatment of the surface is obtained.

c) Fatigue to operator is increased due to the extra effort.

Figure 5:
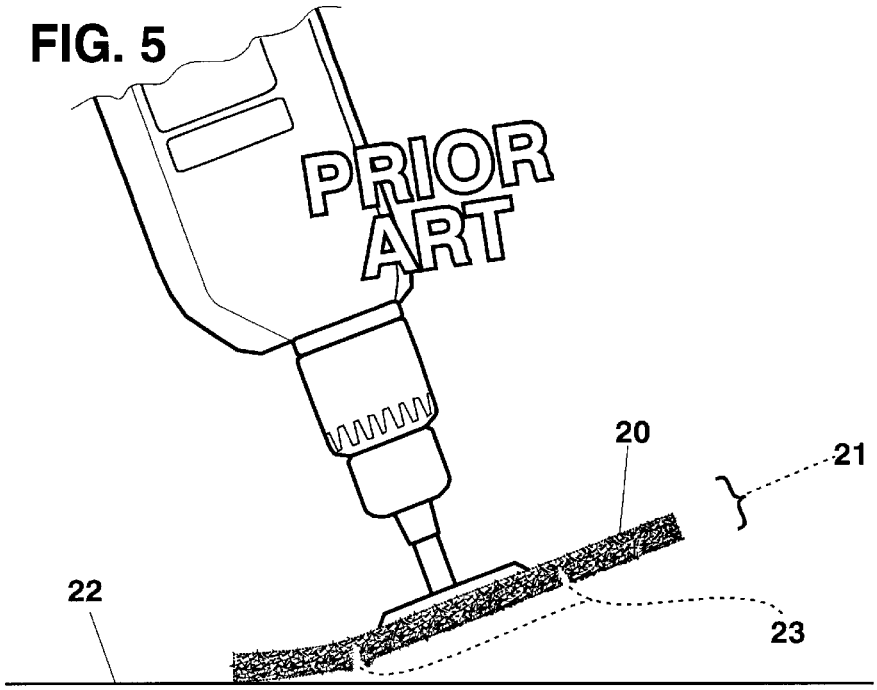
FIG. 5 is a partial side view of a drill showing in cross section the concentric rupture in progress of an abrasive disk of the prior art.

FIG. 5 shows a partial side view of a wire disk 20 and in cross section 21 point 23 where disk is being ruptured in a concentric fashion, due to the forced operation of the rotary tool as explained with FIG. 4.

Figure 6:
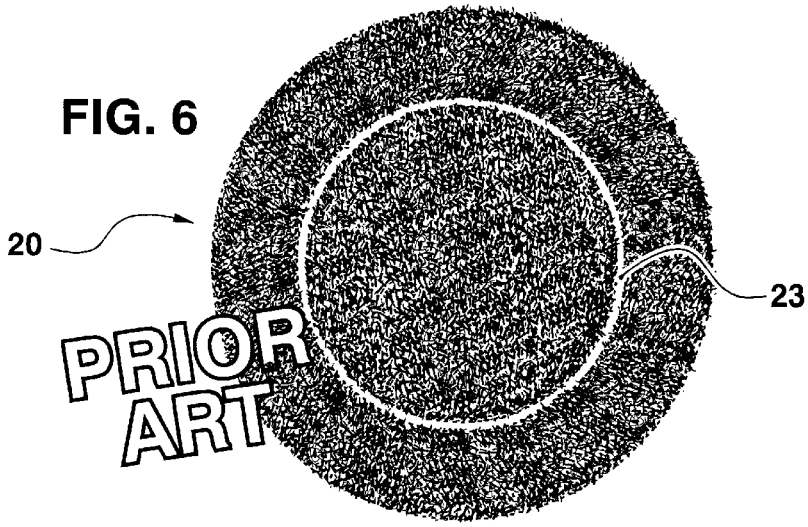
FIG. 6 is a plan frontal view of disk of the prior art that suffered a concentric rupture.

Point 23 appears duplicated because of the side cross section view, but it is one single circular line, as can be seen in FIG. 6.

FIG. 6 shows in front plan view the wire disk of FIG. 5, showing said point of rupture 23, as a continuous circular line.

Figure 7:
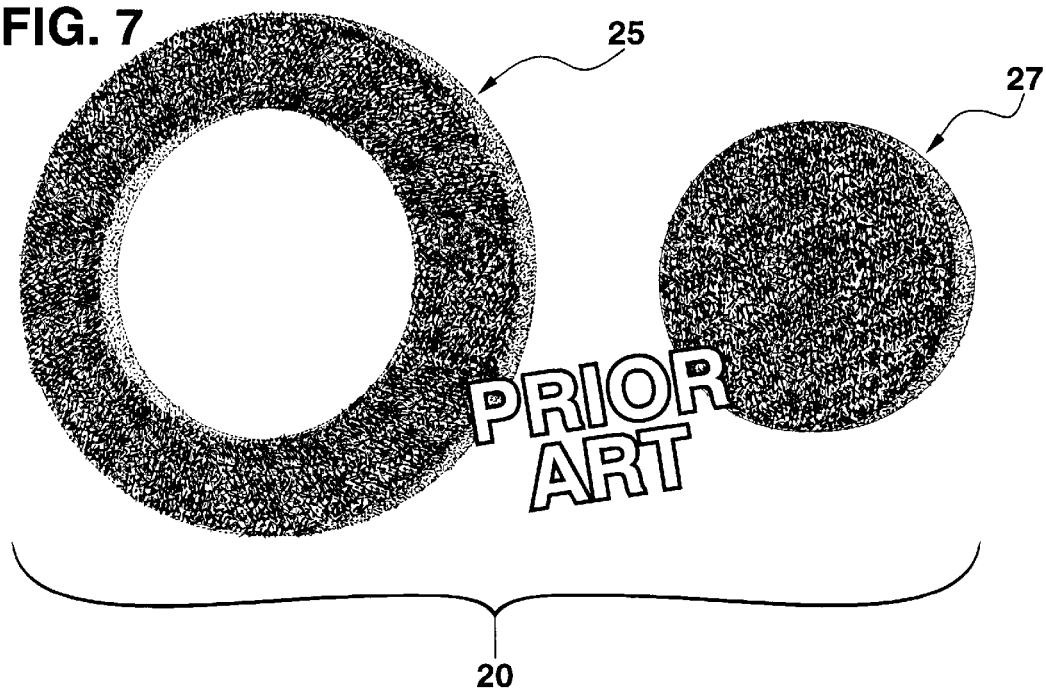
FIG. 7 is a perspective view of an abrasive disk of the prior art that has been fractured into two pieces.

FIG. 7 shows in perspective view the wire disk of FIGS. 5 and 6 after the concentric rupture into two pieces has fully taken place. Pieces 25 and 27 are the resultant of such rupture. Wire disk is rendered useless.

DRAWINGS

Present Invention

Figure 8:
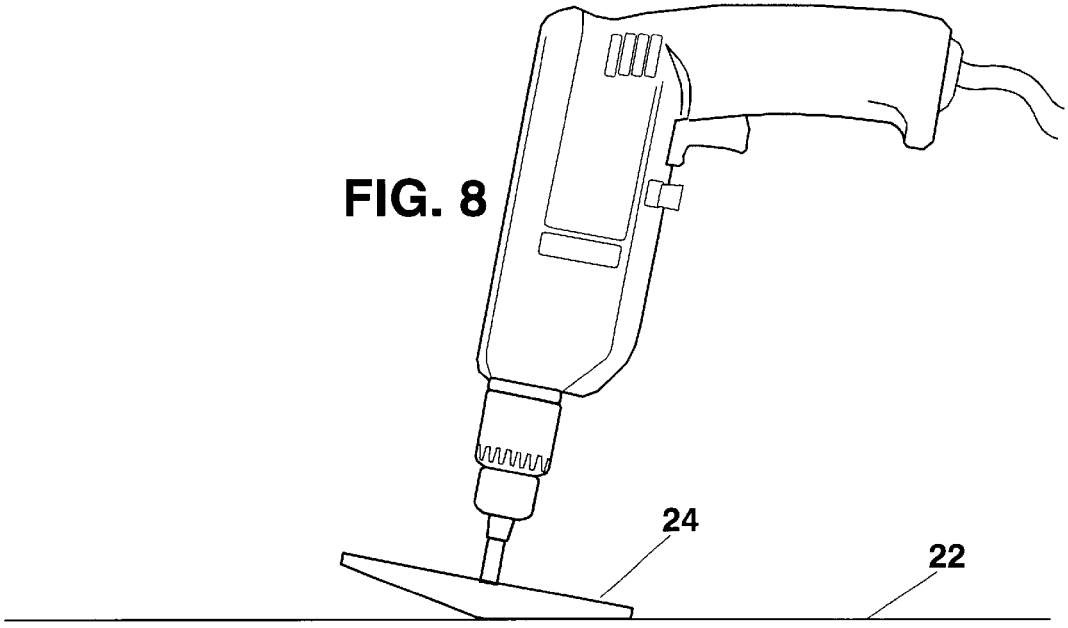
FIG. 8 is a side view of a drill as an example of a rotary tool, having a disk of the present invention applied against a surface.

FIG. 8 shows in side view a rotary tool (a drill, in this case) having a disk 24 of the present invention, with a conical shape applied to a surface 22. The disk enters in contact with the surface to be treated in a fashion that maximizes the effect of the centrifugal force, which is radially distributed throughout the entire surface of the disk by virtue of its conical shape, and then transferred to the surface being treated.

An optimized treatment of the surface is achieved while all the problems of the prior art are avoided. The tool is easily controlled, disengagement of the disk and/or other accessories is prevented. Slipping and accidental harm to operator, operator's clothes and any surrounding objects is prevented. As a result of all the preceding advantages, substantial savings are achieved. This is further enhanced by the increased durability of the disks and materials, and the fact that disks can now be of a larger diameter, due to the optimized control of operation.

Figure 9:
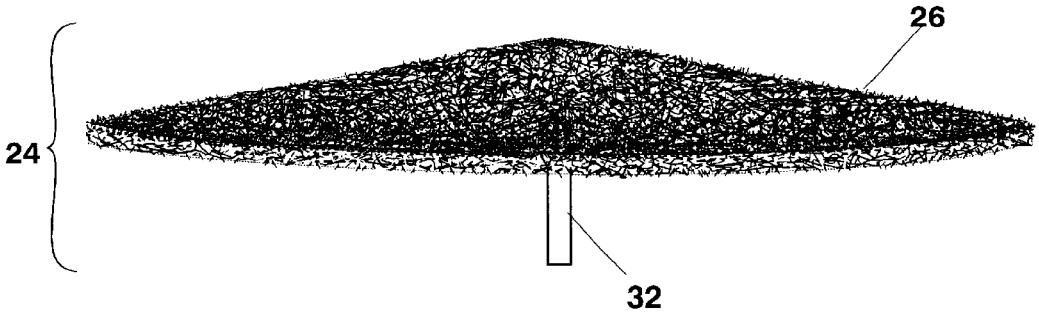
FIG. 9 is a side view of a wire disk of the present invention.

FIG. 9 shows a side/isometric view of a disk attachment 24 of the present invention. The disk attachment has a treating side 26 with surface treatment properties. Attachment means 32 represented in this case by a shank.

Figure 10:
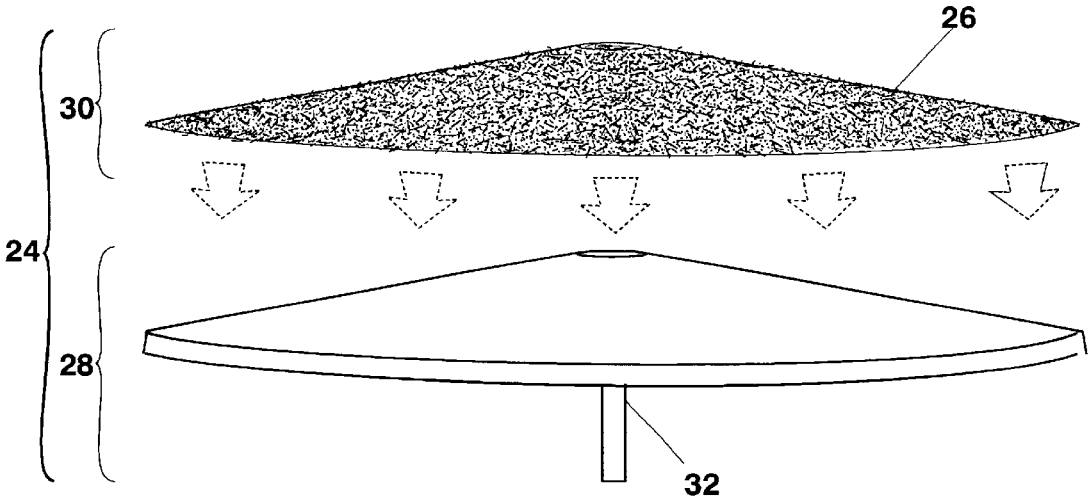
FIG. 10 is a side view of a padded disk and mating sand paper of the present invention.

FIG. 10 shows a side/isometric view of a disk attachment 24 having a disk area 28 serving as a padded base for layer 30, represented in this case by self adhesive sand paper having a mating shape, with respect to the disk 24. Dotted arrows indicate positioning of layer over padded disk. And attachment means 32, represented in this case by a shank.

Figure 11:
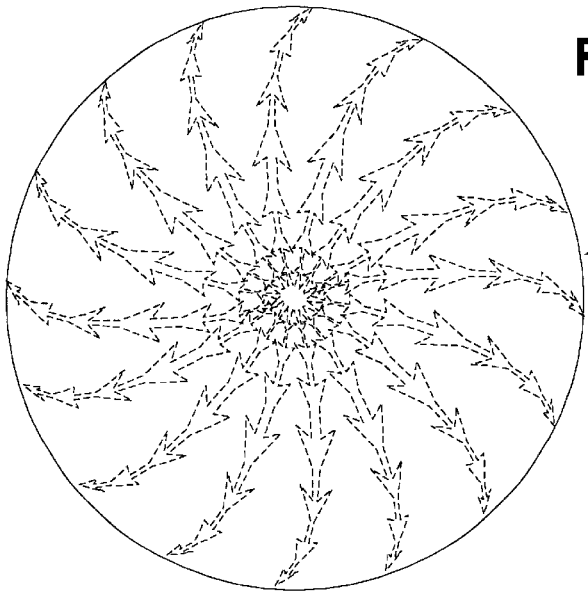
FIG. 11 is a plan frontal view of a disk of the present invention showing me direction of the centrifugal force.

FIG. 11 shows in a plan frontal view a disk of the present invention, with dotted arrows indicating the direction of the centrifugal force. By virtue of its conical shape, the effect of this force is uniformly distributed throughout the entire disk, with all the advantages that this entails.

Figure 12:
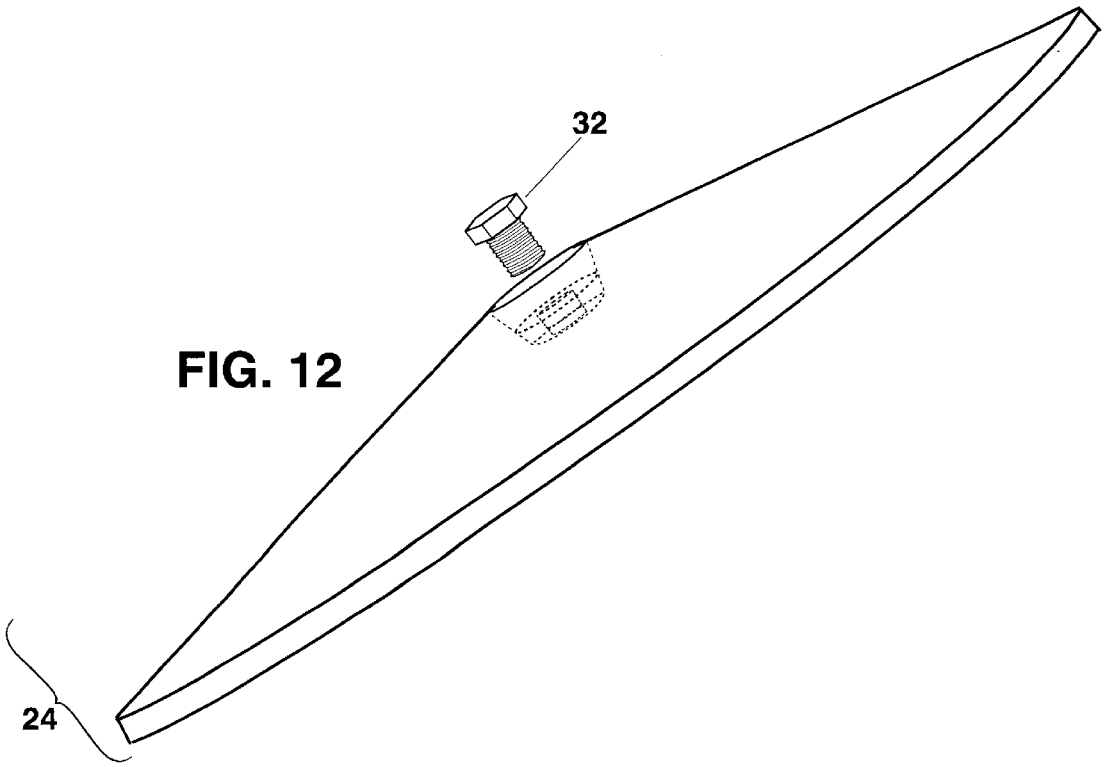
FIG. 12 is an isometric view of a disk of the present invention with ghost lines and showing alternative means to fasten to a rotary tool.

FIG. 12 shows an isometric view of a disk of the present invention 24 having attachment means 32, represented in this case by a bolt, and further having a recessed area, and a hole, to host said bolt and connect it to the rotary tool.

CONCLUSIONS, RAMIFICATIONS AND SCOPE

The reader will see that the surface treatment disk of the present invention represents a substantial improvement over the prior art.

It eliminates all the disadvantages of the prior art disks, while making possible disks of a larger diameter. All of which is further enhanced by its simplicity of construction and use.

The preceding description includes certain specificities, given for illustrative purposes. They are not in any way to be restrictive, and natural equivalents will have the same effect within the scope of this invention. For example, the paper of the sand paper may be replaced by any other suitable sheet material, like for instance a product known in the market as "Tyvek™". Other means to attach the disk to the rotary tool may include clamps, hooks, or any other suitable mechanism.

What is claimed is:

1. A method to treat surfaces, comprising the steps of:

providing a disk attachable to a rotary tool, providing means to attach said disk to said rotary tool, providing a back side to said disk wherein said back side is the one side which is the closest to said rotary tool when said disk is attached to said rotary tool, providing a front side to said disc wherein said front side is the one side which is the farthest from said rotary tool when said disk is attached to said rotary tool, providing a substantially conical shape to said front side of said disk, wherein said substantially conical shape projects in opposite direction from said back side of said disk, providing an obtuse angle to said substantially conical shape, providing a predetermined texture to said front side, whereby said method to treat surfaces is enabled when said disk is attached to said rotary tool, and said rotary tool is rotating.

2. The method of claim 1, wherein said substantially conical shape is further defined as absolutely conical.

3. The method of claim 1, wherein said rotary tool is a drill, said means to attach said disk to said rotary tool is a shank emerging from said back side, and said predetermined texture is of abrasive properties.

4. The method of claim 2, wherein said rotary tool is a drill, said means to attach said disk to said rotary tool is a shank emerging from said back side, and said predetermined texture is of abrasive properties.

5. A disk attachable to a rotary tool, comprising:

a first side and a second side, and means to attach said disk to said rotary tool, wherein said first side and said second side are opposite one another, and said first side is proximal to said rotary tool when said disk is attached to said rotary tool, and wherein said second side has a substantially conical shape projecting in opposite direction from said first side, and wherein the angle of said substantially conical shape is obtuse, and wherein said second side further has a predetermined texture so as to treat surfaces.

6. The disk of claim 5, wherein said substantially conical shape is further defined as absolutely conical.

7. The disk of claim 1, wherein said rotary tool is a drill, said means to attach said disk to said rotary tool is a shank emerging from said first side, and said predetermined texture is of abrasive properties.

8. The disk of claim 6, wherein said rotary tool is a drill, said means to attach said disk to said rotary tool is a shank emerging from said first side, and said predetermined texture is of abrasive properties.

9. A method to treat surfaces, comprising the steps of:

providing a disk pad, attachable to a rotary tool, wherein said disk pad has a front side and a back side, wherein said back side is the one side that is the closest to said rotary tool when said disk pad is attached to said rotary tool, providing a substantially conical shape to said front side, wherein said substantially conical shape projects away from said back side, providing an obtuse angle to said substantially conical shape, providing means to attach said disk pad to a rotary tool, providing a layer, attachable to said disk pad, wherein said layer has a front side and a back side, wherein said front side has a predetermined texture, providing a substantially conical shape to said layer, providing an obtuse angle to said substantially conical shape, so said layer can be in a mating condition with said disk pad, when said back side of said layer is placed in contact with said front side of said disk pad, providing means to attach said disk layer to said disk pad.

10. The method of 9, wherein said substantially conical shape of said disk pad is further defined as absolutely conical and said substantially conical shape of said layer is further defined as absolutely conical.

11. The method of claim 9, wherein said rotary tool is a drill, said means to attach said disk pad to said rotary tool is a shank emerging from said back side of said disk pad and said predetermined texture is of abrasive properties.

12. The method of claim 10, wherein said rotary tool is a drill, said means to attach said disk pad to said rotary tool is a shank emerging from said back side of said disk pad and said predetermined texture is of abrasive properties.

13. The method of claim 9, wherein said means to attach said layer to said disk pad is pressure sensitive adhesive applied to said back side of said layer.

14. The method of claim 10, wherein said means to attach said layer to said disk pad is pressure sensitive adhesive applied to said back side of said layer.

15. The method of claim 9, wherein said front side of said disk pad is one face of two faces, and said back side of said layer is the other face of said two faces, wherein said fastening means is the hook and loop system, enabled by providing at least one portion of the hook element to at least one of said two faces, and providing at least one portion of the loop element to at least one of said two faces, in such a manner that when said two faces are in contact to one another, said at least one portion of the hook element engages with said at least one portion of the loop element.

16. An assembly attachable to a rotary tool, comprising:

a) a disk member, wherein said disk member has a first side and a second side, wherein said first side and said second side are opposite one another, and said first side is proximal to said rotary tool when said disk member is attached to said rotary tool, wherein said second side has a substantially conical shape projecting in opposite direction from said first side, wherein the angle of said substantially conical shape of said second side is obtuse, b) a disk layer attachable to said disk member, wherein said disk layer has a substantially conical shape and wherein the angle of said substantially conical shape of said disk layer is obtuse, so as to mate with said disk member, when said disk layer is positioned in mating contact with said second side of said disk member, c) means to attach said disk layer to said disk member, whereby said assembly can be assembled, and d) means to attach said assembly to said rotary tool.

17. The assembly of claim 16, wherein said substantially conical shape of said disk member is further defined as absolutely conical and said substantially conical shape of said disk layer is further defined as absolutely conical.

18. The assembly of claim 16, wherein said rotary tool is a drill, said means to attach said disk member to said rotary tool is a shank emerging from said first side of said disk member and said predetermined texture is of abrasive properties.

19. The assembly of claim 16, wherein said means to attach said layer to said disk pad is pressure sensitive adhesive applied to said back side of said layer.

20. The assembly of claim 17, wherein said means to attach said layer to said disk pad is pressure sensitive adhesive applied to said back side of said layer.

* * * * *